US006551141B2

(12) United States Patent
Liang

(10) Patent No.: US 6,551,141 B2
(45) Date of Patent: Apr. 22, 2003

(54) FUSE BOX

(76) Inventor: Wen Liang, 10/F., No. 65, Changshou 2nd St., Wufu Tsun, Luchu Hsiang, Taoyuan County (TW)

( * ) Notice: Subject to any disclaimer, the term of this patent is extended or adjusted under 35 U.S.C. 154(b) by 0 days.

(21) Appl. No.: 09/927,383

(22) Filed: Aug. 13, 2001

(65) Prior Publication Data

US 2003/0032332 A1 Feb. 13, 2003

(51) Int. Cl.[7] ..... H01R 13/68
(52) U.S. Cl. ..... 439/621; 439/830; 439/811
(58) Field of Search ..... 439/620, 621, 439/431, 811, 830–833

(56) References Cited

U.S. PATENT DOCUMENTS 4,070,086 A * 1/1978 Trafford ..... 439/621
4,550,965 A * 11/1985 Izraeli ..... 439/431
5,328,392 A * 7/1994 Lin et al. ..... 439/833
5,551,894 A * 9/1996 Lin et al. ..... 439/621
5,664,971 A * 9/1997 Coy ..... 439/811
6,162,097 A * 12/2000 Liang ..... 439/621

* cited by examiner

*Primary Examiner*—Hien Vu
(74) *Attorney, Agent, or Firm*—Rosenberg, Klein & Lee

(57) ABSTRACT

A fuse box in which wire distribution blocks each have a receiving chamber and a metal wire clip in the receiving chamber, and tightening up screws are respectively threaded into the wire distribution blocks to compress the respective metal wire clips and to force the respective metal wire clips into positive engagement with respective electric wires. Metal spring plates are mounted in respective oblique insertion holes in the wire distribution blocks to hold fuses in a tilted position, so that less vertical installation space is occupied.

5 Claims, 8 Drawing Sheets

FUSE BOX

BACKGROUND OF THE INVENTION

The present invention relates to a fuse box and, more particularly, to such a fuse box that is easy to install and that keeps the electric wires positively in the connected position when installed.

FIGS. 9 and 10 show a fuse box according to the prior art. According to this design, the electric wire 77 is inserted into a wire hole 72 of the distribution block 7, and a pointed screw rod 73 is threaded into a screw hole 71 of the distribution block 7 to hold down the core 78 of the electric wire 77. This design has drawbacks. Because the tightening up screw sues its pointed tip to hold down the core of the electric wire, the electric wire tends to be pulled away from the wire distribution block. Further, much driving force must be employed to the tightening up screw during installation, and the core of the electric wire tends to be broken when driving the tightening up screw into the screw hole of the wire distribution block to hold down the core of the electric wire.

FIGS. 11 and 12 show another structure of fuse box according to the prior art. According to this design, the wire distribution block 8 has a tapered wire hole 82 and an inner thread 81 around the orifice of the tapered wire hole 82. A wire clamp 83 is mounted on the core 88 of the electric wire 87 and inserted with the core 88 of the electric wire 87 into the tapered wire hole 82. The wire clamp 83 has longitudinal splits 831. A connector 84 is mounted on the electric wire 87 and fastened to the tapered wire hole 82 to force the wire clamp 83 into engagement with the periphery of the core 88 of the electric wire 87. The connector 84 has one end terminating in a screw tube 841 and threaded into the inner thread 81 of the wire distribution block 8, and an opposite end terminating in a plurality of equiangularly spaced clamping strips 843. The clamping strips 843 have outer threads 842 and inner ribs 844. When threading the screw tube 841 into the inner thread 81 of the wire distribution block 8, the wire clamp 83 is forced by the connector 84 into the inside of the tapered wire hole 82, thereby causing the wire clamp 83 to be radially inwardly forced by the tapered peripheral wall of the tapered wire hole 82 into engagement with the periphery of the core 88 of the electric wire 87. Further, a lock nut 86 is threaded onto the outer threads 842 of the clamping strips 843 of the connector 84, forcing the inner rids 844 of the clamping strips 83 into engagement with the electrically insulative shell of the electric wire 87. This design is complicated. Because many component parts are used, the manufacturing cost of this design of fuse box is expensive. Further, the installation procedure of this design of fuse box is also complicated.

Further, in the aforesaid prior art fuse boxes, metal fuse clamps 76;89 are respectively welded to the wire distribution blocks 7;8, and adapted to receive the terminals 751 ; 851 of fuses 75;85. These metal fuse clamps 76;89 provide less clamping force to the terminals 751; 851 of installed fuses 75;85, and installed fuses 75;85 tend to be forced out of position accidentally. Furthermore, because fuses 75;85 are to be installed in the top cover 74;9 of the fuse box in vertical, much vertical installation space is required.

SUMMARY OF THE INVENTION

The present invention has been accomplished to provide a fuse box, which eliminates the aforesaid drawbacks. According to one aspect of the present invention, the fuse box comprises a mount, a plurality of wire distribution blocks respectively fixedly mounted on the mount, the wire distribution blocks including one power input distribution and a plurality of power output distribution blocks, a plurality of metal wire clips respectively mounted in the wire distribution blocks and adapted to secure the core of a respective electric wire, the metal wire clips each comprising two horizontal clamping walls horizontally disposed at different elevations and having a respective serrated portion for engaging the electrically insulative shell of an electric wire, and two vertical support walls bilaterally disposed between the horizontal clamping walls and defining with the horizontal clamping walls a receiving space adapted to receive the core of an electric wire, and a plurality of tightening up screws respectively threaded into a respective screw hole in the wire distribution blocks to force the serrated portions of the metal wire clips into engagement with the electrically insulative shell of the respective electric wires being inserted into the wire distribution blocks. According to another aspect of the present invention, the wire distribution blocks each have at least one oblique insertion slot and a respective metal spring plate mounted in each oblique insertion slot and adapted to receive the terminals of fuses positively.

DETAILED DESCRIPTION OF THE PREFERRED EMBODIMENT

Figure 4:
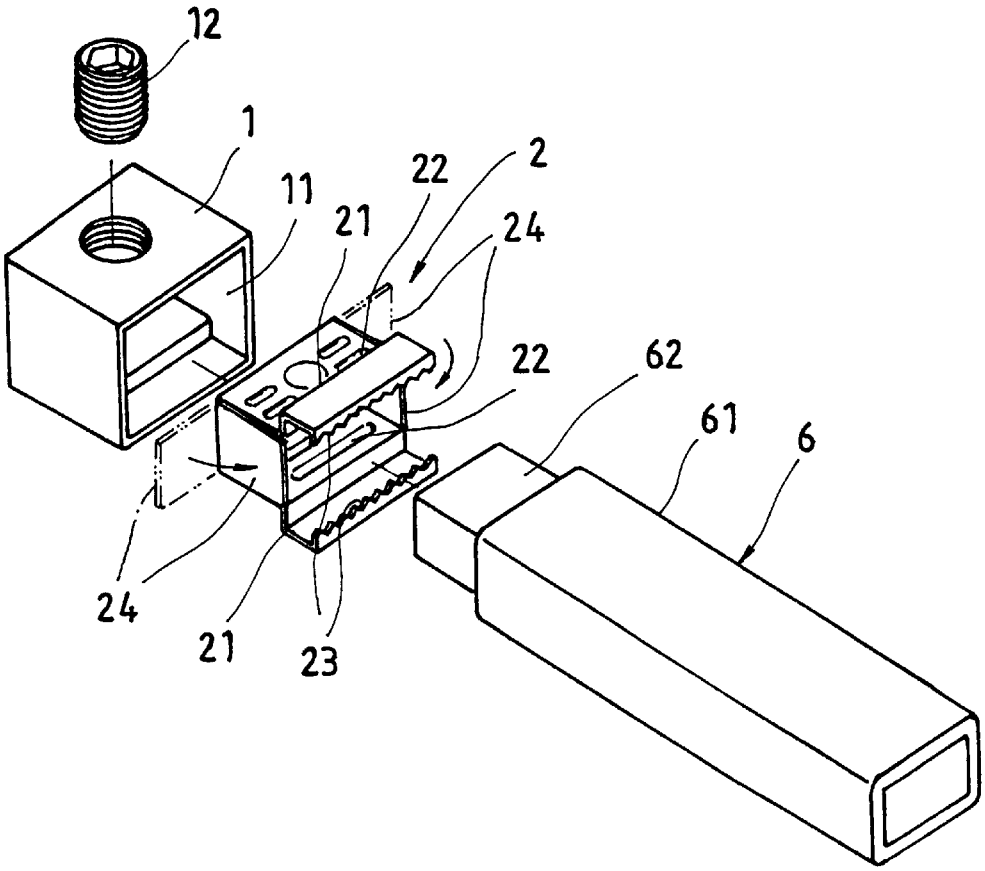
FIG. 4 is an exploded view showing the positioning of a metal wire clip between one wire distribution block and an electric wire of rectangular cross section according to the present invention.
Figure 5:
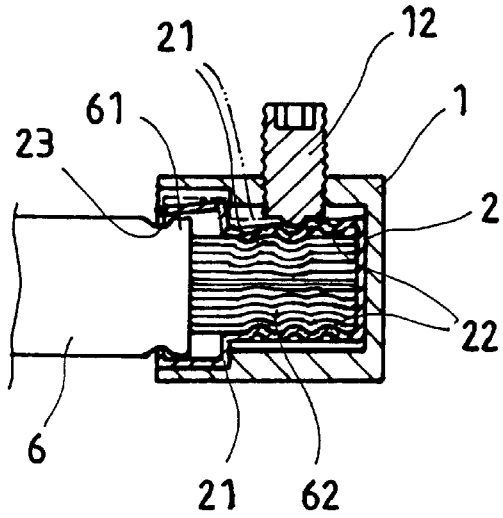
FIG. 5 is a sectional assembly view of FIG. 4
Figure 6:
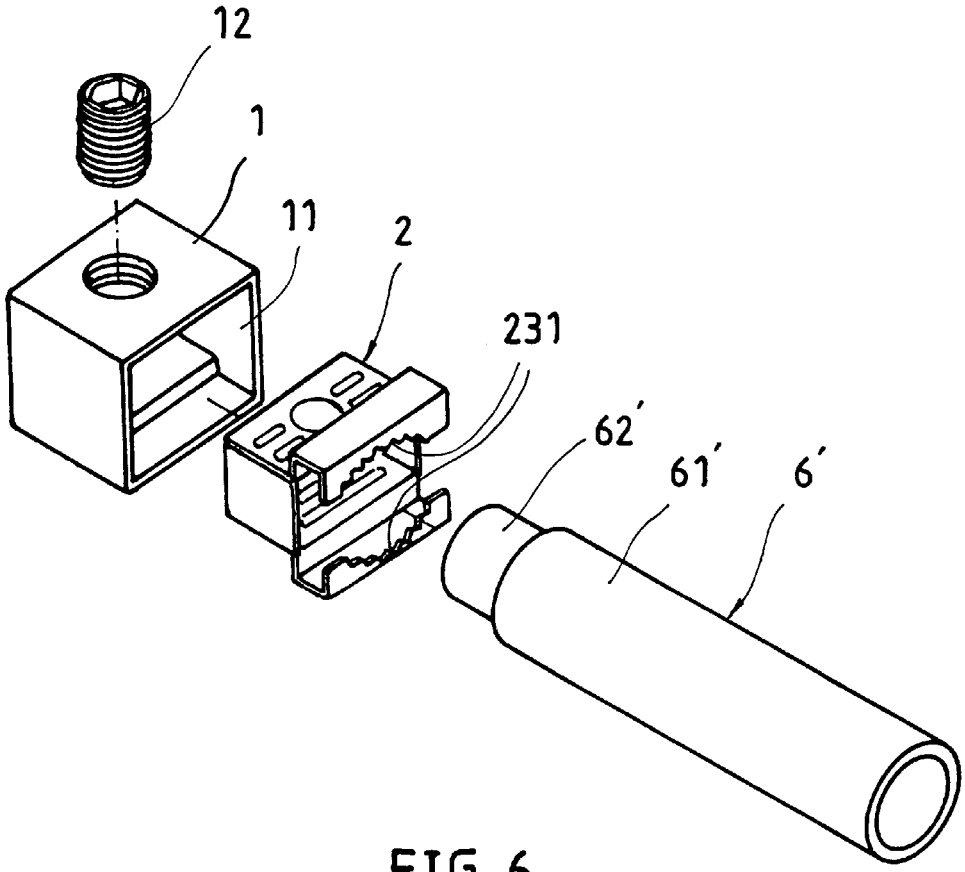
FIG. 6 is an exploded view showing the positioning of a metal wire clip between one wire distribution block and an electric wire of circular cross section according to the present invention.

Referring to FIGS. from 1 through 5, a fuse box is shown comprising an electrically insulative flat mount 4. Electrically insulative wire distribution blocks 1;3 are fixedly mounted on the top sidewall of the flat mount 4 for the wiring of electric wires 6. Each wire distribution block 1 or 3 has at least one receiving chamber 11 or 31 and a metal wire clip 2 mounted in each receiving chamber 11 or 31. The metal wire clip 2 comprises to horizontal clamping walls 21 horizontally disposed at different elevations, and two vertical support walls 24 bilaterally disposed between the horizontal clamping walls 21. The horizontal clamping walls 21 and the vertical support walls 24 define a receiving space adapted to receive the core 62 of an electric wire 6. The horizontal clamping walls 21 each have transverse ribs 22 respectively formed integral with the respective inner surface, and a front side terminating in a serrated clamping portion 23. The horizontal clamping walls 21 have the respective serrated clamping portion 23 facing each other. After insertion of the core 62 of an electric wire 6 in the receiving space defined within the metal wire clip 2 in the receiving chamber 11 or 31 of one wire distribution block 1 or 3, a tightening up screw 12 or 32 is fastened to the wire distribution block 1 or 3 and pressed against the respective metal wire clip 2 to force the serrated clamping portion 23 of each of the horizontal clamping walls 21 into engagement with the electrically insulative shell 61 of the inserted electric wire 6. The serrated clamping portions 23 of the horizontal clamping walls 21 may be designed to fit the core 62 of an electric wires 6 of rectangular cross section as shown in FIG. 4, or to fit the core 62' of an electric wires 6' of circular cross section as shown in FIG. 6.

Figure 1:
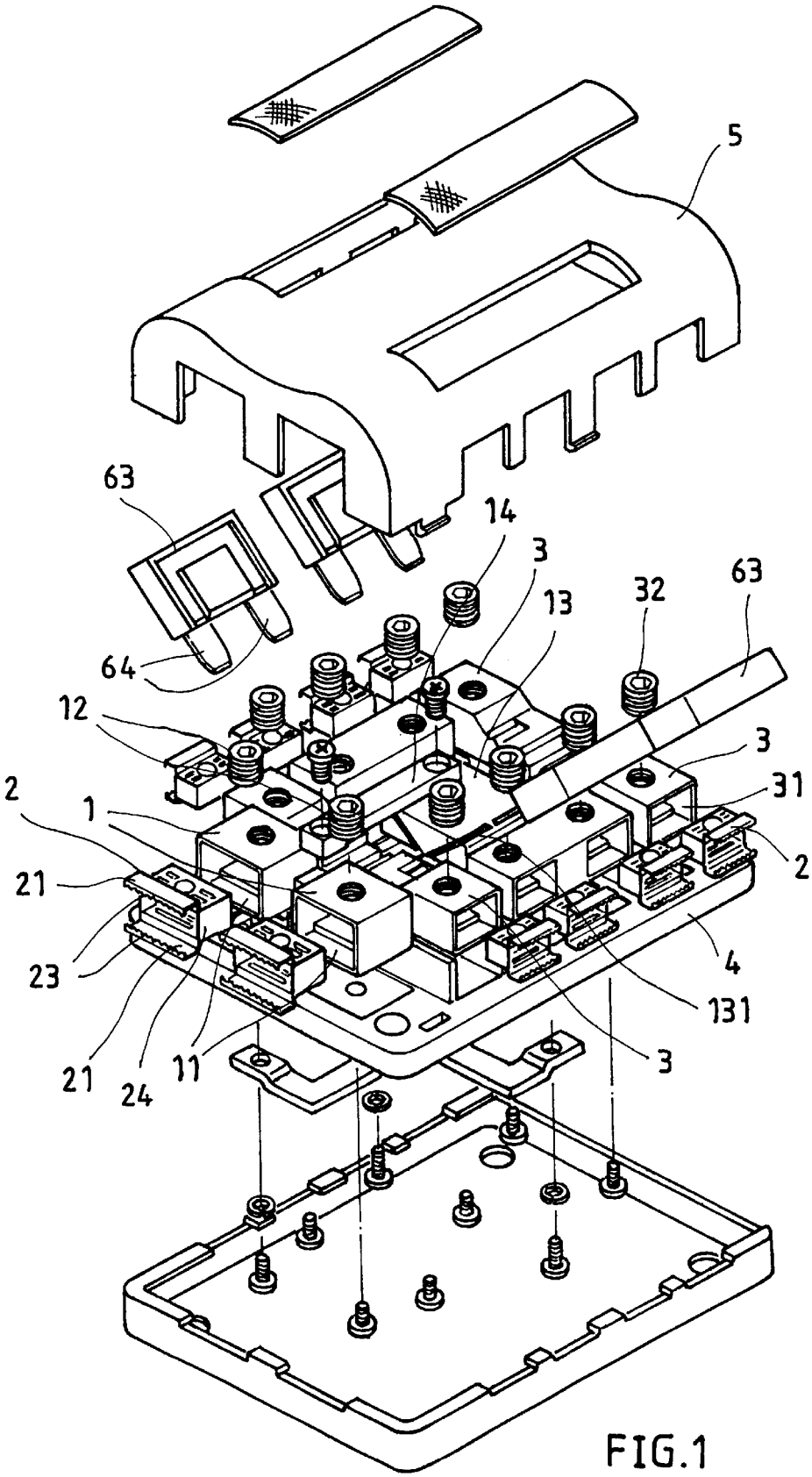
FIG. 1 is an exploded view of a fuse box according to the present invention.
Figure 2:
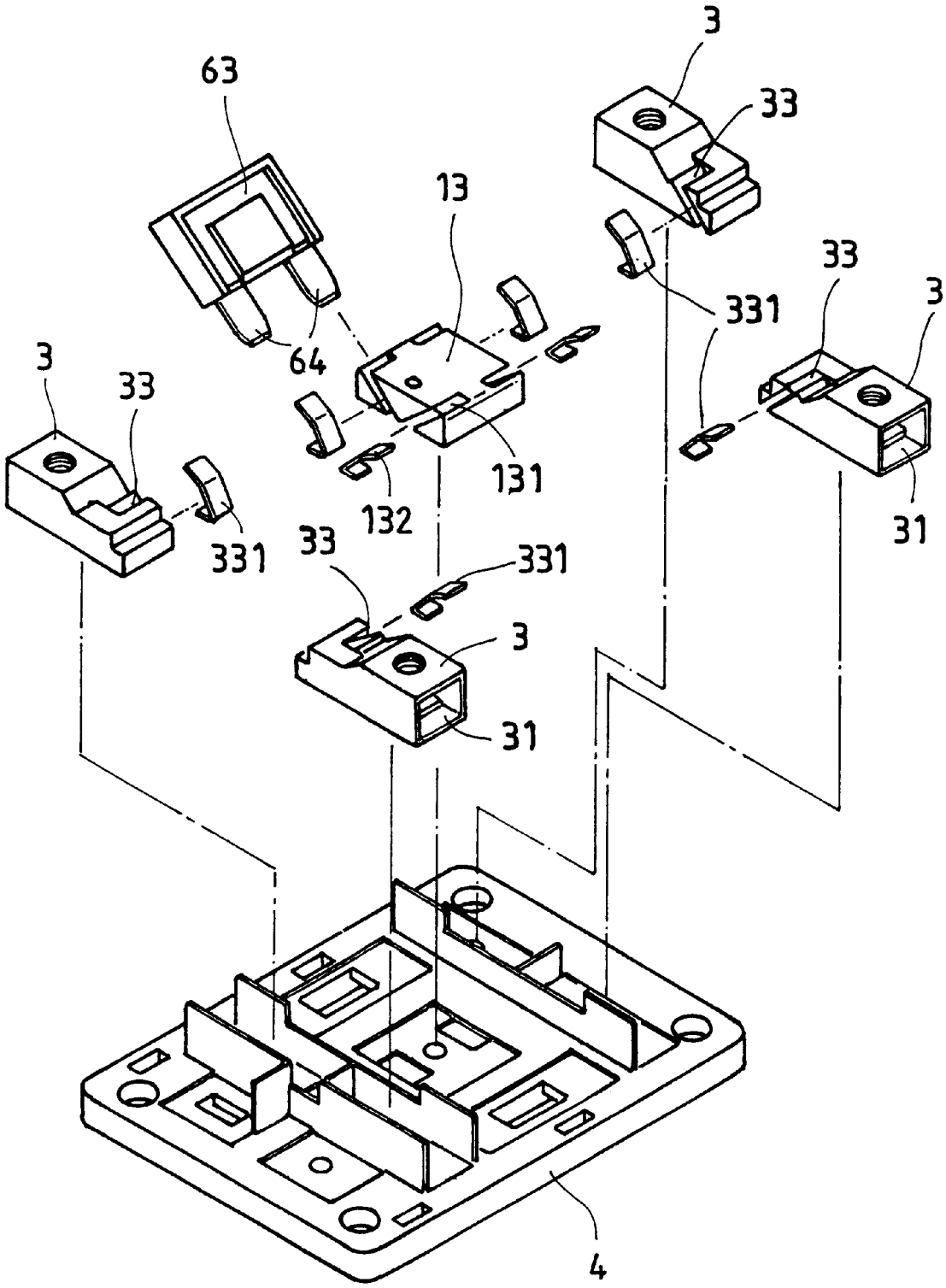
FIG. 2 is an exploded view of a part of the fuse box according to the present invention.
Figure 3:
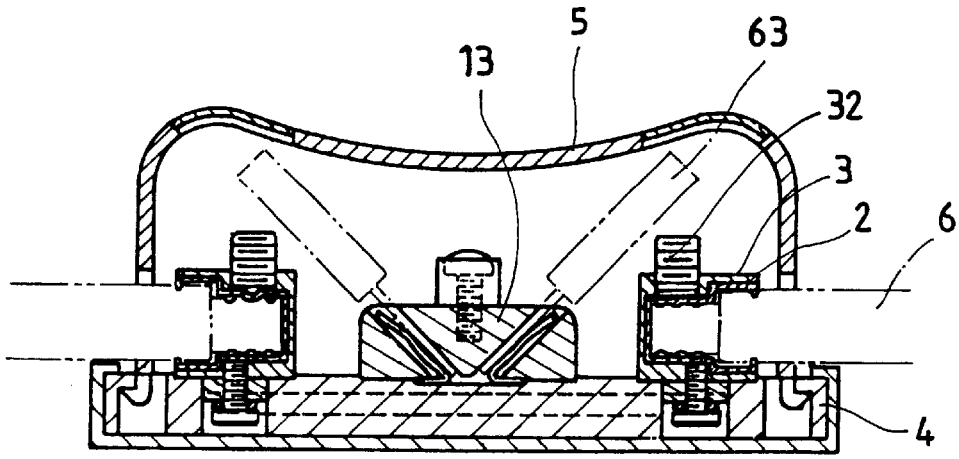
FIG. 3 is an installed view in section of the fuse box according to the present invention.
Figure 8:
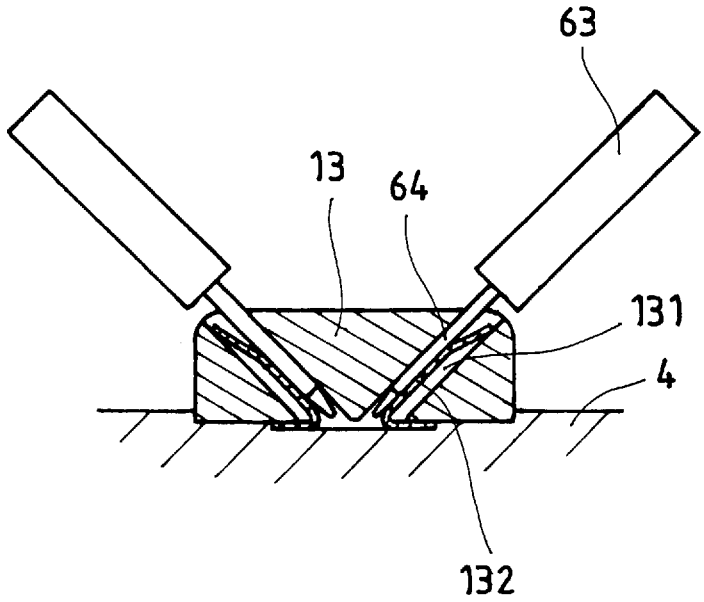
FIG. 8 is a sectional view showing two fuses obliquely installed in the center distribution block according to the present invention.
Figure 9:
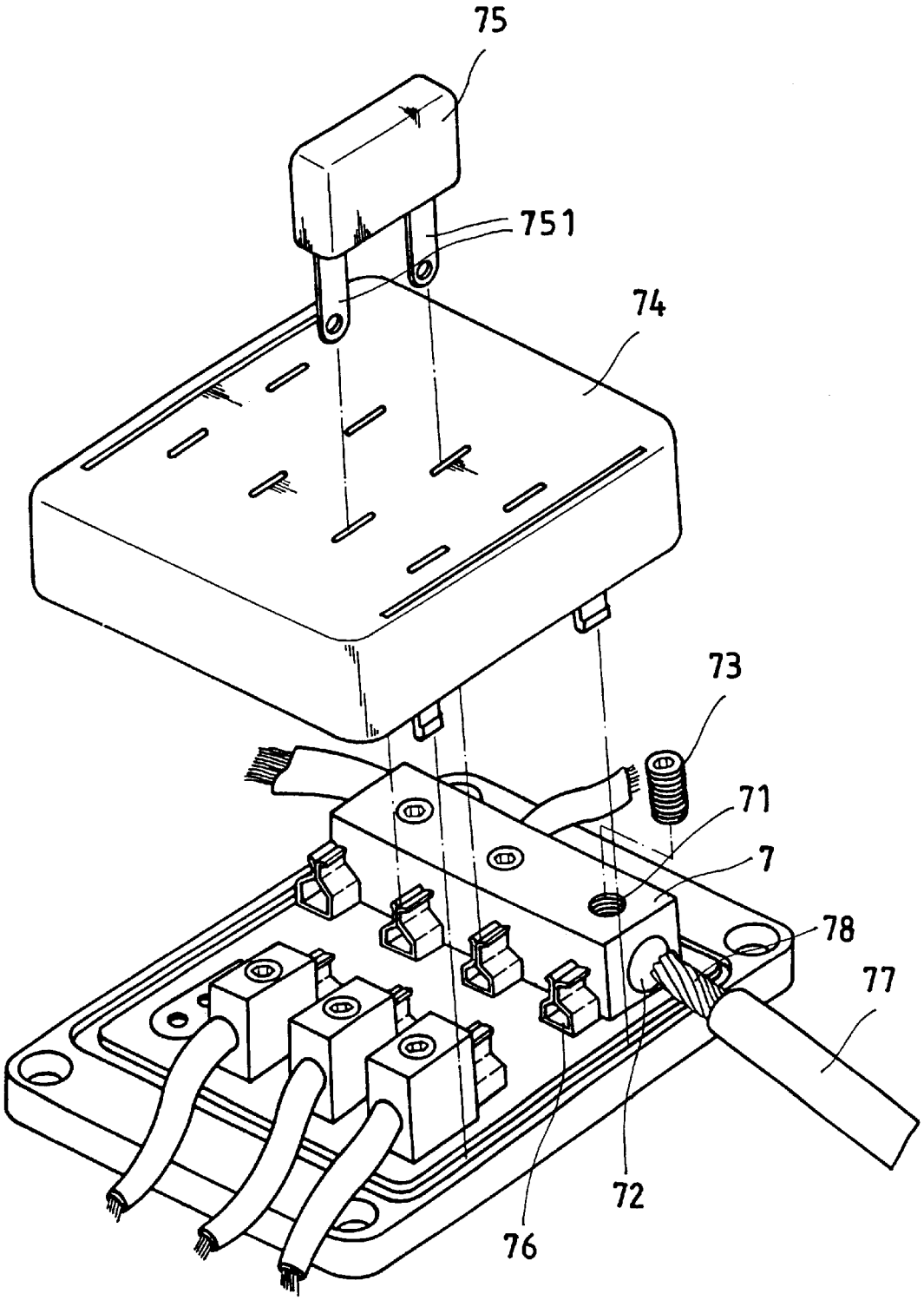
FIG.9 PRIOR ART
FIG. 9 is an exploded view of a fuse box according to the prior art.
Figure 10:
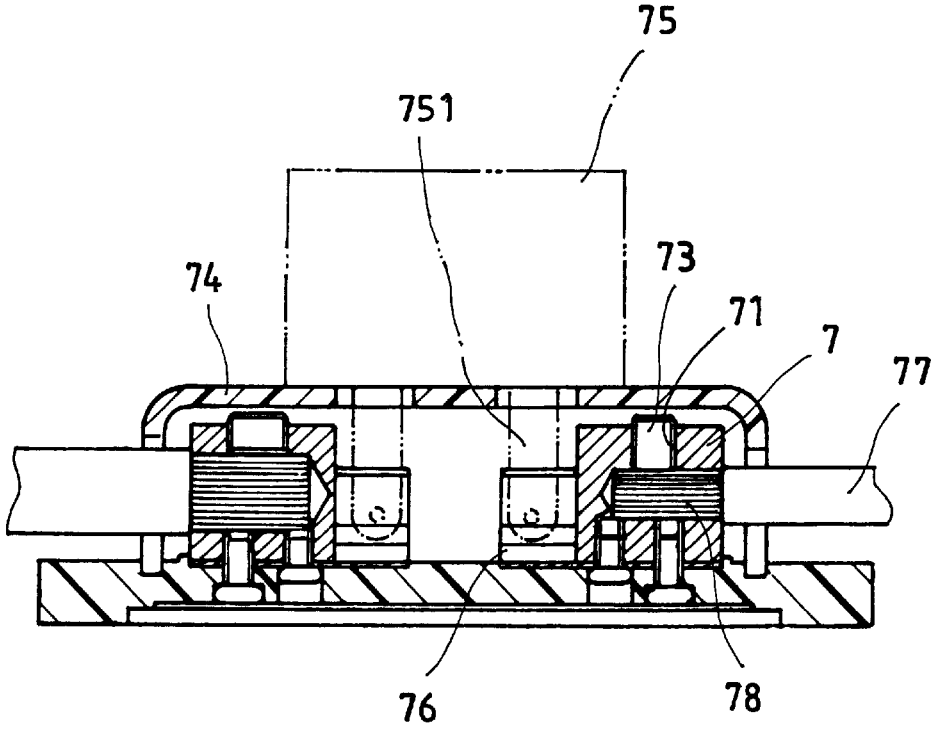
FIG.10 PRIOR ART
FIG. 10 is a sectional assembly view of the prior art fuse box shown in FIG. 9.
Figure 12:
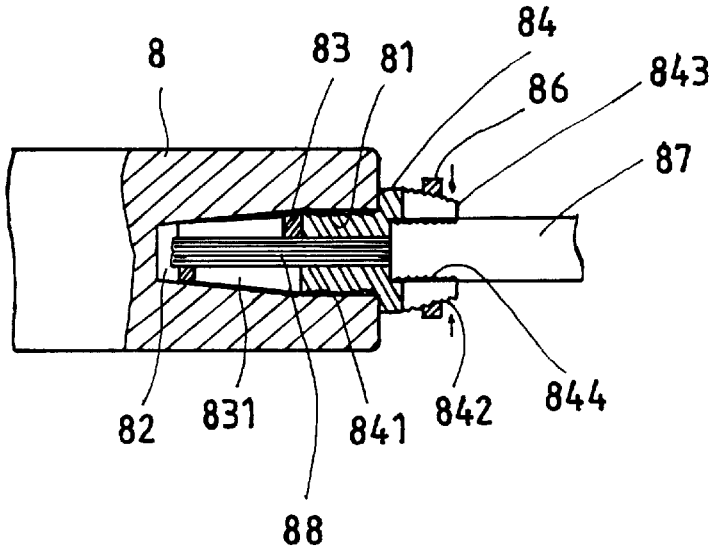
FIG.12 PRIOR ART
FIG. 12 is a sectional view of a part of the prior art fuse box of FIG. 11.
Figure 11:
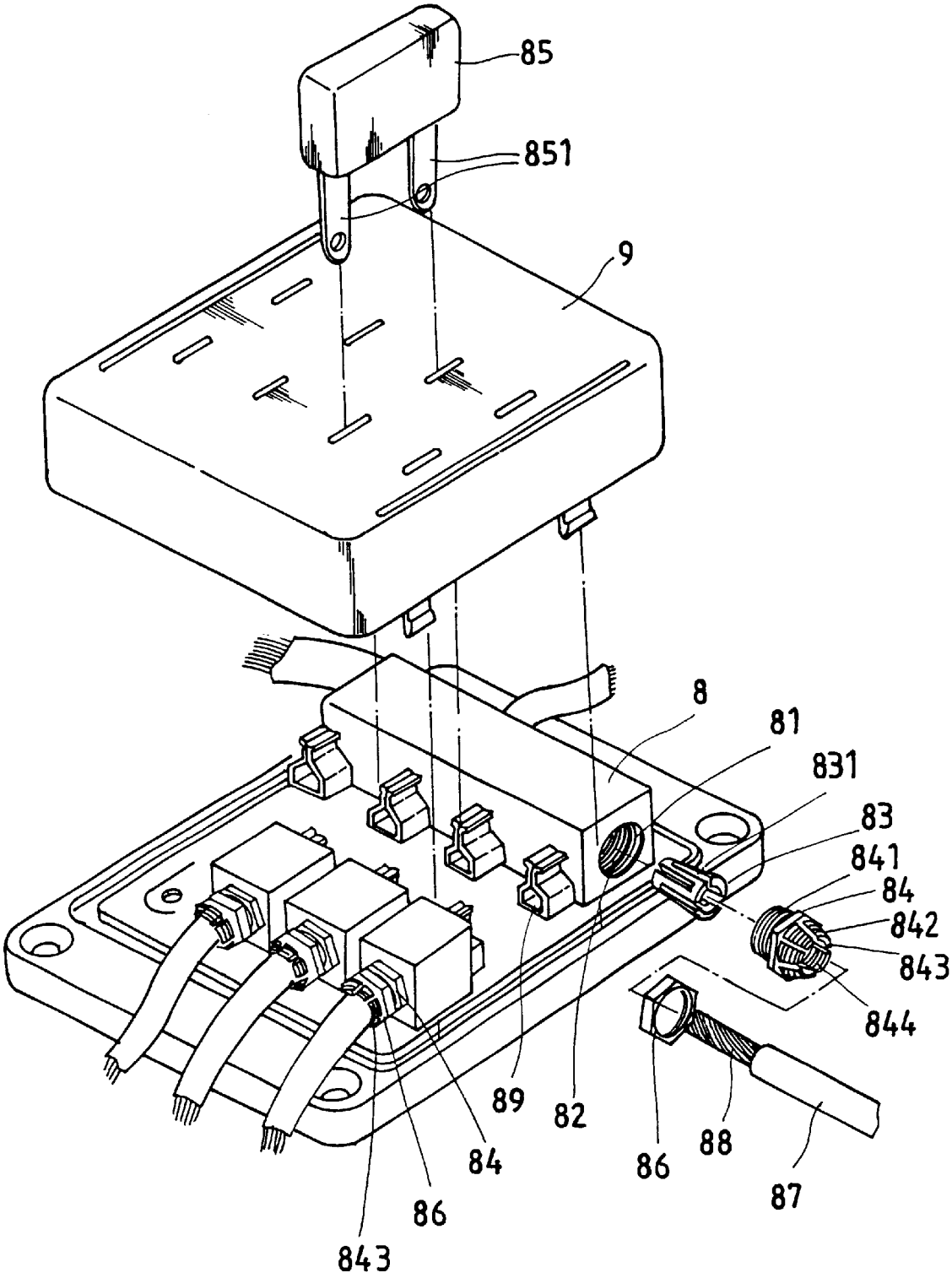
FIG.11 PRIOR ART
FIG. 11 is an exploded view of another structure of fuse box according to the prior art.

The aforesaid wire distribution blocks 1;3 include one power input distribution block 1 for power input and a plurality of power output distribution blocks 3 for power output. A center distribution block 13 is fixedly mounted on the top sidewall of the electrically insulative flat mount 4 at the center. A metal conductive plate 14 is connected between the center distribution block 13 and the power input distribution block 1, enabling input power supply to be transmitted from the power input distribution block 1 to the power output distribution blocks 3 through the center distribution block 13. The center distribution block 13 has a plurality of oblique insertion slots 131 adapted to receive one terminal 64 of a fuse 63. The power output distribution blocks 3 each have an oblique insertion slot 33 corresponding to one oblique insertion slot 131 of the center distribution block 13 adapted to receive one terminal 64 of a fuse 63. Metal spring plates 132;331 are respectively mounted in the oblique insertion slots 131;33 and adapted to hold down the terminals 64 of inserted fuses 63. When one fuse 63 is installed, the two terminals 64 of the inserted fuse 63 are respectively inserted into one oblique insertion slot 131 of the center distribution block 13 and the oblique insertion slot 33 of one power output distribution block 3, and maintained in close contact with the metal spring plates 132;331 in the respective oblique insertion slots 131;33. After installation, an electrically insulative top cover shell 5 is closed on the electrically insulative flat mount 4. Because fuses 63 are maintained in a tilted position after installation, the height of the fuse box is greatly reduced (see FIGS. 3 and 8).

Figure 7:
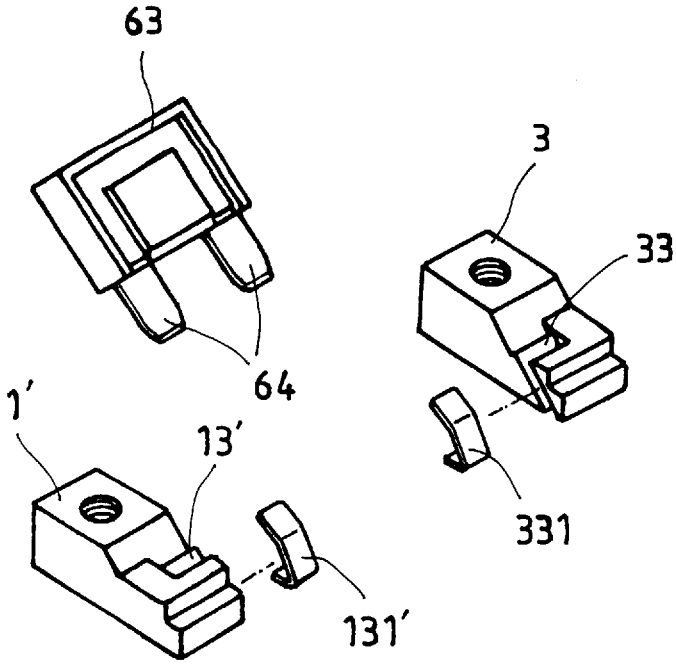
FIG. 7 is an exploded view showing the positioning of a fuse between the power input distribution block and one power output distribution block according to the present invention.

Referring to FIG. 7, the power input distribution block 1' is made having an oblique insertion slot 13' and a metal spring plate 131' mounted in the oblique insertion slot 13'. The two terminals 64 of a fuse 63 are directly inserted into the oblique insertion slot 13' of the power input distribution block 1' and the oblique insertion slot 33 of one power output distribution block 3 to contact the respective metal spring plates 131';331, i.e., the fuse 63 transmits power supply from the power input distribution block 1' to the power output distribution block 3 and automatically cuts off the circuit between the power input distribution block 1' and the power output distribution block 3 upon an overload.

It is to be understood that the drawings are designed for purposes of illustration only, and are not intended for use as a definition of the limits and scope of the invention disclosed.

What the invention claimed is:

1. A fuse box comprising:

a mount;

a plurality of wire distribution blocks respectively fixedly mounted on said mount, said wire distribution blocks including one power input distribution and a plurality of power output distribution blocks each having at least one receiving chamber at one side;

a plurality of metal wire clips respectively mounted in the receiving chamber of each of said wire distribution blocks and adapted to secure a core of an electric wire, said metal wire clips each comprising two horizontal clamping walls horizontally disposed at different elevations, and two vertical support walls bilaterally disposed between said horizontal clamping walls, said vertical support walls and said horizontal clamping walls defining a receiving space adapted to receive the core of an electric wire, said horizontal clamping walls each having a plurality of transverse ribs formed on an inner surface thereof and having a front end terminating at a serrated portion forming a plurality of teeth projections for conformingly and securely engaging an insulative shell of an electric wire; and, a plurality of tightening up screws threaded into respective screw holes formed in said wire distribution blocks for depressing said metal wire clips, the serrated portions of each said metal wire clips being thereby forced into engagement with an insulative shell of the electric wire inserted into one of said wire distribution blocks.

2. The fuse box as claimed in claim 1 wherein said serrated portions of said metal wire clips each extend to generally form an acuate concavity for engaging a circular cross section of the electric wire in conformed manner.

3. A fuse box comprising:

a mount;

a plurality of wire distribution blocks respectively fixedly mounted on said mount, said wire distribution blocks including one power input distribution and a plurality of power output distribution blocks each having at least one receiving chamber at one side;

a plurality of metal wire clips respectively mounted in the receiving chamber of each of said wire distribution blocks and adapted to secure a core of an electric wire, said metal wire clips each comprising two horizontal clamping walls horizontally disposed at different elevations, and two vertical support walls bilaterally disposed between said horizontal clamping walls, said vertical support walls and said horizontal clamping walls defining a receiving space adapted to receive the core of an electric wire, said horizontal clamping walls each having a plurality of transverse ribs formed on an inner surface thereof and having a front end terminating at a serrated portion for conformingly and securely engaging an insulative shell of an electric wire; and a plurality of tightening up screws threaded into respective screw holes formed in said wire distribution blocks for depressing said metal wire clips, the serrated portions of each said metal wire clip being thereby forced into engagement with an insulative shell of the electric wire inserted into one of said wire distribution block;

said power input distribution block has an oblique insertion slot and a metal spring plate mounted in the oblique insertion slot for receiving one terminal of a fuse, and said power output distribution blocks each have an oblique insertion slot corresponding to one oblique insertion slot of said power input distribution block and a metal spring plate mounted in the oblique insertion slot for receiving one terminal of a fuse.

4. A fuse box comprising:

a mount;

a plurality of wire distribution blocks respectively fixedly mounted on said mount, said wire distribution blocks including one power input distribution and a plurality of power output distribution blocks each having at least one receiving chamber at one side;

a plurality of metal wire clips respectively mounted in the receiving chamber of each of said wire distribution blocks and adapted to secure a core of an electric wire, said metal wire clips each comprising two horizontal clamping walls horizontally disposed at different elevations, and two vertical support walls bilaterally disposed between said horizontal clamping walls, said vertical support walls and said horizontal clamping walls defining a receiving space adapted to receive the core of an electric wire, said horizontal clamping walls each having a plurality of transverse ribs formed on an inner surface thereof and having a front end terminating at a serrated portion forming a plurality of teeth projections for conformingly and securely engaging an insulative shell of an electric wire; and a plurality of tightening up screws threaded into respective screw holes formed in said wire distribution blocks for depressing said metal wire clips, the serrated portions in said metal wire clips being thereby forced into engagement with an insulative shell of the electric wire inserted into one of said wire distribution block;

a center distribution block fixedly mounted on center of said mount for connection to said power output distribution blocks by fuse for transmission power supply from said power input distribution block to said power output distribution blocks; and, a metal conductive plate connected between said center distribution block and said power input distribution block for enabling power supply to be transmitted from said power input distribution block to said center distribution block and then from said center distribution block to said power output distribution blocks by fuse coupling.

5. A fuse box comprising:

a mount;

a plurality of wire distribution blocks respectively fixedly mounted on said mount, said wire distribution blocks including one power input distribution and a plurality of power output distribution blocks each having at least one receiving chamber at one side;

a plurality of metal wire clips respectively mounted in the receiving chamber of each of said wire distribution blocks and adapted to secure a core of an electric wire, said metal wire clips each comprising two horizontal clamping walls horizontally disposed at different elevations, and two vertical support walls bilaterally disposed between said horizontal clamping walls, said vertical support walls and said horizontal clamping walls defining a receiving space adapted to receive the core of an electric wire, said horizontal clamping walls each having a plurality of transverse ribs formed on an inner surface thereof and having a front end terminating at a serrate portion for conformingly and securely engaging an insulative shell of an electric wire;

a plurality of tightening tip screws threaded into respective screw holes formed in said wire distribution blocks for depressing said metal wire clips, the serrated portions of each said metal wire clip being thereby forced into engagement with an insulative shell of the electric wire inserted into one of said wire distribution blocks;

a center distribution block fixedly mounted at a center of said mount for connection to said power output distribution blocks by fuse for transmission power supply from said power input distribution block to said power output distribution blocks; and, a metal conductive plate connected between said center distribution block and said power input distribution block for enabling power supply to be transmitted from said power input distribution block to said center distribution block and then from said center distribution block to said power output distribution blocks by fuse coupling;

said power output distribution blocks each have an oblique insertion slot and a metal spring plate mounted in the respective oblique insertion slot for receiving one terminal of a respective fuse, and said center distribution block has a plurality of oblique insertion slots corresponding to the oblique insertion slot of each of said power output distribution blocks and a plurality of metal spring plates respectively mounted in the respective oblique insertion slots for receiving one terminal of a respective fuse.

* * * * *